United States Patent [19]

Feldpausch

[11] 4,198,719

[45] Apr. 22, 1980

[54] TENT PEG MALLET AND REMOVER

[76] Inventor: Gary R. Feldpausch, 2412 Vollmer Rd., Richmond, Va. 23229

[21] Appl. No.: 958,028

[22] Filed: Nov. 6, 1978

[51] Int. Cl.[2] ..... B66F 15/00

[52] U.S. Cl. ..... 7/146; 7/166; 254/132

[58] Field of Search ..... 254/30, 132, 131; 7/166, 146, 143, 114

[56] References Cited

U.S. PATENT DOCUMENTS

| | | | |
|---|---|---|---|
| 1,581,935 | 4/1926 | Lase | 254/132 |
| 3,867,733 | 2/1975 | Verlander | 254/132 |
| 4,112,530 | 9/1978 | Lecce et al. | 254/132 |

*Primary Examiner*—Robert C. Watson

*Attorney, Agent, or Firm*—Jacobi, Lilling & Siegel

[57] ABSTRACT

A tent peg mallet and extracting tool is provided which includes a variety of functional portions to perform operations on wooden, metal, or plastic tent pegs or the like. The tool includes a mallet portion having a face for pounding wooden or plastic pegs without damage, a rigid plate secured to the mallet portion for pounding metal pegs, a tab extending from the end of the mallet portion for digging or prying to loosen the pegs, and a peg removal loop secured to the mallet portion to facilitate peg pulling.

8 Claims, 5 Drawing Figures

FIG. 1
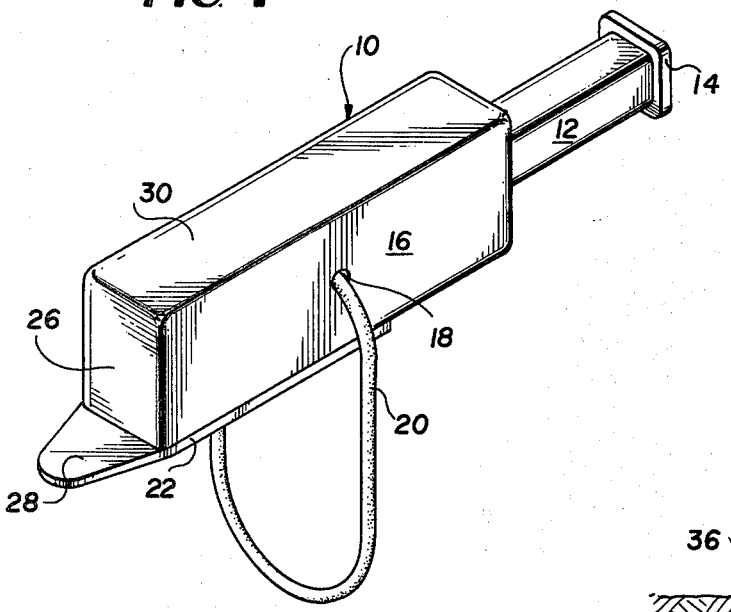
FIG. 2
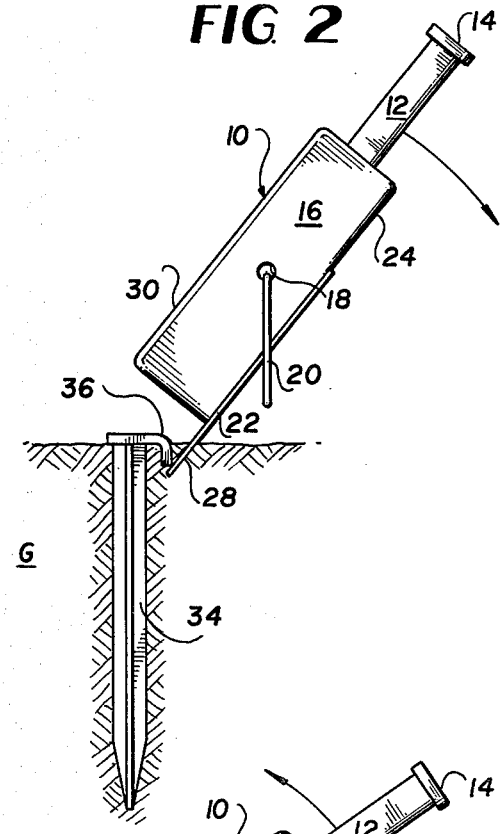
FIG. 3
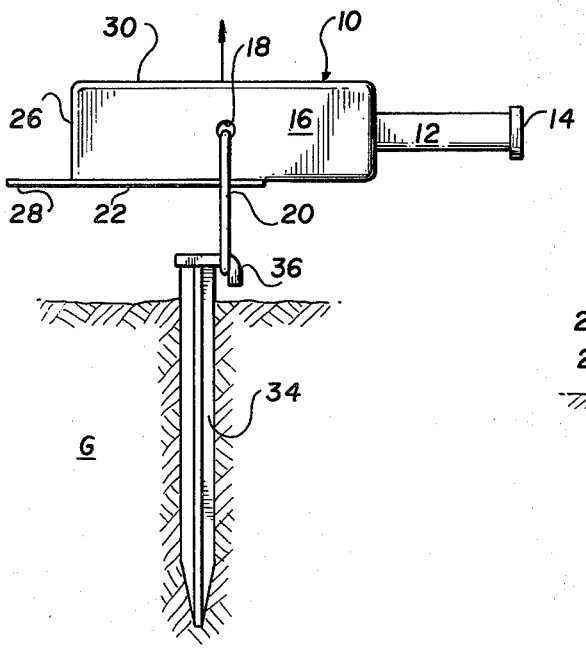
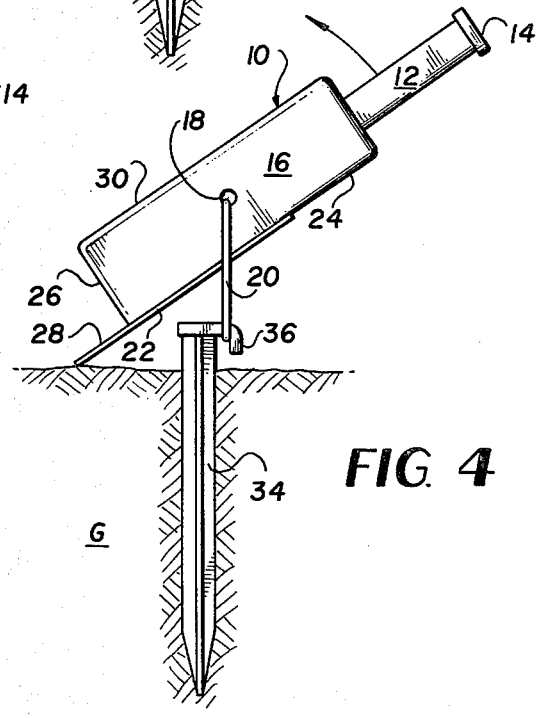
FIG. 4

TENT PEG MALLET AND REMOVER

BACKGROUND OF THE INVENTION

The present invention relates to a tent peg mallet and removing tool and, more particularly, to such a tool which facilitates the installation and removal of tent pegs or the like formed at various materials.

In camping, and especially in back pack camping, it is very desirable that any piece of equipment perform a variety of functions in order that the weight and bulk to be carried may be reduced to a minimum. In this vein, there is a need for a tool that may be used with equal facility for both pounding and removing a variety of types of tent pegs or the like in a variety of ground circumstances.

A basic tent peg mallet is of sufficient strength and bulk to allow a controlled blow to be addressed to the peg to drive it into the ground rather than to split or damage the peg. For this reason, tent peg mallets for wooden or plastic pegs should have mass combined with a wooden, leather, or similar yielding driving surface. Conversely, aluminum or steel tent pegs may damage such a yielding driving surface and a metal driving surface is preferable.

In pulling tent pegs, an attachment point is desirable which will readily conform to the variety of hooks that are provided on tent pegs for holding the tent ropes, and a comfortable grip is required to exert the pull required. In many ground conditions, it is necessary to drive the tent pegs down until the top is flush with the ground or even slightly below ground in order to provide an adequate anchor for the tension applied to the tent ropes. In these circumstances it is necessary to employ a tool to dig around the tent peg top or pry on the hook portion with mechanical advantage in order to remove the tent peg.

It will be readily seen, therefore, that a need has arisen for a simple tool that can be conveniently used to drive tent pegs of different materials and to remove tent pegs from the ground.

SUMMARY OF THE INVENTION

The present invention provides a simple and inexpensive tent peg driving and removal tool of multiple utility functions. This tool comprises a mallet of sufficient mass for easy tent peg driving provided with alternately usable driving surfaces that are yielding or hard as may be required by the type of peg being used. A tent peg pulling loop is conveniently located on the tool to allow balances one or two-handed pulling or mechanical advantage as desired. A protruding tab is also provided on the tool which may be used for digging around the upper end of a tent peg or prying the peg loose with considerable mechanical advantage.

BRIEF DESCRIPTION OF THE DRAWINGS

FIG. 1 is a perspective view of the tool of the present invention;

FIG. 2 is a side elevational view of the tool illustrating a mode of employment thereof;

FIG. 3 is a view similar to FIG. 2 illustrating a second mode of employment of the tool;

FIG. 4 is a view similar to FIGS. 2 and 3 illustrating a third mode of employment of the tool.

DESCRIPTION OF THE PREFERRED EMBODIMENTS

Figure 5:
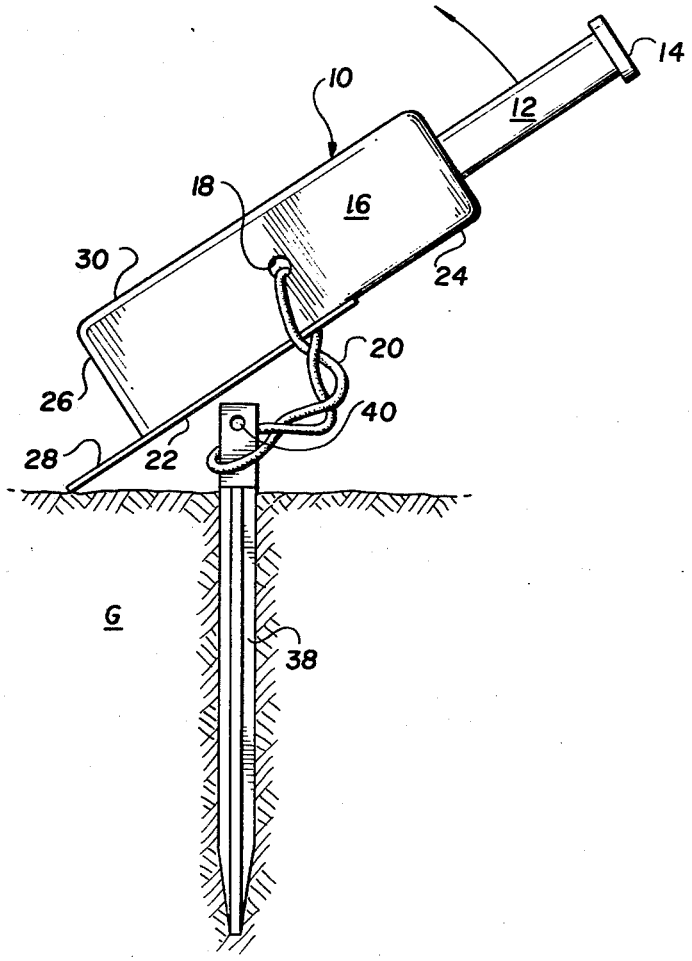
FIG. 5 is a view similar to FIGS. 2, 3 and 4 illustrating a fourth mode of employment on a different type of peg.

The tool 10 of the present invention comprises a handle portion 12 comfortably fitting the hand and having an enlarged end 14 as is well known in the art for preventing the mallet from slipping from the hand in use. The handle 12 merges at its inner end with or is rigidly connected to a mallet portion 16 preferably having a generally rectangular or square cross section. The mallet portion 16 may be formed of any durable material, such as wood, plastic or a hard rubber composition, and preferably is made from a relatively hard wood such as oak, as is well known in the art. Also, the mallet portion 16 may be of any other suitable cross section within the scope of the present invention.

A hole 18 extends through the center section of the mallet portion 16, and a continuous loop of strong, preferably non-elastic, flexible cord or cable 20 extends through the hole 18. The cable 20 may be formed of any suitable material.

A plate 22, peferably formed of rigid metal stock or another suitable material, is attached by means of screws or other suitable fastening means (not shown) to one face 24 of the mallet portion 16. The plate 22 preferably covers a substantial portion of the face 24 of the mallet portion so as to be conveniently used for striking or driving. The plate 22 extends beyond the front face 20 of the mallet portion 16 to define a tab 28. The tab 28 preferably is formed in a general spade-like shape as shown in the drawing, but may be formed in other shapes as may be desired.

In use, the tool 10 may be employed to drive tent pegs of plastic, wood or metal by contacting the pegs with either the face 30 or the plate 22 attached to the opposite face 24, as required by the tent peg material. For example, the face 30 could be used to drive wooden or plastic pegs, and the plate 22 could be used to drive metal pegs.

Referring now to FIGS. 2, 3, and 4, a typical tent peg 34 is shown, embedded into the ground G and provided with a typical hook portion 36 at its upper end designed to form an anchor point for a tent guy rope or the like.

In FIG. 2, the tent peg 34 is embedded into the ground G to a degree which places the end of the hook portion 36 below the ground level. In this instance, the tab 28 may be used as shown to dig around the tent peg 34 and may be applied to the hook 36 as a lever by applying pressure on the handle as indicated by the arrow to apply considerable lifting force to the peg 34. Also, the tab 28 may be used to dig around the hook 36 to expose it so it can be engaged by the cable 20.

In FIG. 3, the cable 20 is engaged in the exposed hook portion 36 to allow a lifting force to be applied to the peg 34 in the direction of the arrow in a balanced manner by grasping the tool 10 with one or two hands on either side of the hole 18.

In FIG. 4, the cable 20 is engaged in the exposed hook portion 36 and upward pressure is applied to the peg 34 by pulling on the handle portion 12 in the direction of the arrow while using the tab 28 as a fulcrum. Because of the engagement of the end of the tab 28 with the ground, it is not likely to slip while being so used.

In FIG. 5, the cable 20 is engaged on a peg 38 which is of a type that does not employ a hook portion but instead employs an eyelet 40 or notch for securing a tent rope. The flexibility of the cable 20 allows it to be twisted or otherwise looped about the body of the peg 38 such that as lifting force is applied the cable 20 tightens around and frictionally grips the peg 38.

It will be readily seen that the tool 10 of the present invention combines a variety of functional parts into a unitary device which can perform the operations of driving and removing tent pegs or the like of virtually any configuration in a variety of circumstances.

What is claimed is:

1. A tool for driving into or removing from the ground a tent peg or the like, said tool comprising:

an elongated mallet portion;

a substantially rigid plate secured to the side of said mallet portion and extending beyond one end thereof to define an outwardly extending, inwardly tapering, substantially rigid tab, and a cable secured to said mallet portion and adapted to engage a tent peg to facilitate its removal from the ground, said mallet portion having a substantially flat side surface and said plate being substantially flat and straight and being secured to said side surface, said plate being of substantially the same width as said side surface and covering a substantial portion thereof so that said plate may be engaged with a peg for driving it into the ground.

2. The tool of claim 1 wherein said mallet portion is formed of wood and said rigid plate is formed of metal.

3. The tool of claim 1 wherein an elongated handle portion is secured to said mallet portion, said handle portion being smaller in transverse dimention than said mallet portion.

4. The tool of claim 3 wherein said handle portion has an elongated outer end.

5. The tool of claim 1 wherein said cable is in the form of a closed loop.

6. The tool of claim 5 wherein said cable is flexible.

7. The tool of claim 6 wherein a hole extends through said mallet portion, and said cable extends through said hole.

8. The tool of claim 7 wherein said cable extends around said plate, the free end of said cable being spaced from said plate and adapted to engage a peg.

* * * * *